US008319721B2

(12) United States Patent
Edwards et al.

(10) Patent No.: US 8,319,721 B2
(45) Date of Patent: Nov. 27, 2012

(54) DISPLAY DEVICES WITH AMBIENT LIGHT SENSING

(75) Inventors: Martin John Edwards, Crawley (GB); John Richard Ayres, Reigate (GB)

(73) Assignee: Chimei Innolux Corporation, Chu-Nan (TW)

( * ) Notice: Subject to any disclaimer, the term of this patent is extended or adjusted under 35 U.S.C. 154(b) by 863 days.

(21) Appl. No.: 12/343,389

(22) Filed: Dec. 23, 2008

(65) Prior Publication Data

US 2009/0167676 A1 Jul. 2, 2009

Related U.S. Application Data

(60) Provisional application No. 61/016,605, filed on Dec. 26, 2007.

(30) Foreign Application Priority Data

Jul. 30, 2008 (EP) ..... 08161494

(51) Int. Cl.
*G09G 3/36* (2006.01)

(52) U.S. Cl. ..... 345/102

(58) Field of Classification Search ..... None
See application file for complete search history.

(56) References Cited

U.S. PATENT DOCUMENTS

| | | | | |
|---|---|---|---|---|
| 5,751,261 | A | 5/1998 | Zavracky et al. | |
| 5,831,693 | A | 11/1998 | McCartney, Jr. et al. | |
| 5,886,681 | A | 3/1999 | Walsh et al. | |
| 6,115,091 | A | 9/2000 | Kondoh et al. | |
| 6,121,950 | A | 9/2000 | Zavracky et al. | |
| 6,144,359 | A | 11/2000 | Grave | |
| 6,320,568 | B1 | 11/2001 | Zavracky | |
| 6,344,641 | B1 | 2/2002 | Blalock et al. | |
| 2002/0158883 | A1 * | 10/2002 | Cheri et al. | 345/589 |
| 2004/0075045 | A1 | 4/2004 | Hermsen | |
| 2005/0184952 | A1 * | 8/2005 | Konno et al. | 345/102 |

(Continued)

FOREIGN PATENT DOCUMENTS

| | | |
|---|---|---|
| EP | 1445643 | 8/2004 |

(Continued)

OTHER PUBLICATIONS

International Search Report of Related Case International App. No. PCT/IB2006/054430.

*Primary Examiner* — Joseph Feild
*Assistant Examiner* — Henok Heyi
(74) *Attorney, Agent, or Firm* — Liu & Liu

(57) ABSTRACT

A method is provided of controlling an illumination source for a display device which comprises a display modulator for modulating the light provided by the illumination source. The method comprises using a light sensor arrangement to generate a first signal based on an ambient light level with first illumination source drive condition, and using the light sensor arrangement to generate a second signal based on the same ambient light level but with second illumination source drive condition different to the first drive condition. The first and second signals are processed to compensate for differences in the light sensor arrangement response characteristics when operating with the first and second illumination source drive conditions thereby to derive a compensated light sensor arrangement characteristic covering both the first and second illumination source drive conditions. Ambient light levels detected using this model of the characteristic are used to control the display device.

17 Claims, 4 Drawing Sheets

U.S. PATENT DOCUMENTS

| | | | | |
|---|---|---|---|---|
| 2005/0231457 | A1* | 10/2005 | Yamamoto et al. | 345/102 |
| 2007/0126757 | A1* | 6/2007 | Itoh et al. | 345/690 |
| 2007/0153157 | A1 | 7/2007 | Kang et al. | |
| 2007/0279384 | A1* | 12/2007 | Brosnan | 345/166 |
| 2008/0094515 | A1* | 4/2008 | Gutta et al. | 348/602 |
| 2008/0154105 | A1* | 6/2008 | LeMay | 600/330 |
| 2008/0165116 | A1* | 7/2008 | Herz et al. | 345/102 |
| 2008/0284716 | A1* | 11/2008 | Edwards et al. | 345/102 |
| 2009/0127461 | A1* | 5/2009 | Holcombe et al. | 250/338.1 |
| 2009/0167192 | A1* | 7/2009 | Diederiks et al. | 315/149 |
| 2009/0167789 | A1* | 7/2009 | Kerofsky | 345/690 |
| 2010/0059296 | A9* | 3/2010 | Abileah et al. | 178/18.09 |

FOREIGN PATENT DOCUMENTS

| | | |
|---|---|---|
| JP | 2000122575 | 4/2000 |
| WO | 00/41378 | 7/2000 |
| WO | 02/37454 | 5/2002 |
| WO | 04/001712 | 12/2003 |
| WO | 2006/117956 | 11/2006 |
| WO | 2007/069107 | 6/2007 |
| WO | WO 2007069107 A2 * | 6/2007 |

* cited by examiner

DISPLAY DEVICES WITH AMBIENT LIGHT SENSING

CROSS REFERENCE TO RELATED APPLICATIONS

This application claims the benefit of U.S. Provisional Application No. 61/016,605 filed on Dec. 26, 2007, the entirety of which is incorporated by reference herein.

This application claims priority of European Patent Application No. 08161494.3, filed on Jul. 30, 2008, the entirety of which is incorporated by reference herein.

BACKGROUND OF THE INVENTION

1. Field of the Invention

This invention relates to display devices, for example display devices using illumination light sources, with the display device modulating the light from the illumination light source.

2. Description of the Related Art

A liquid crystal display is the most common example of this type of modulating display device, and typically comprises an active plate and a passive plate between which liquid crystal material is sandwiched. The active plate comprises an array of transistor switching devices, typically with one transistor associated with each pixel of the display. Each pixel is also associated with a pixel electrode on the active plate to which a signal is applied for controlling the brightness of the individual pixel.

The level of ambient light has a strong influence on the performance of a display device which is used to modulate a light source.

It has been recognised that the performance of displays can be improved by using information from light sensors to modify the operation of the display. For example, the intensity of the backlight of the display may be adjusted in response to information from light sensors which are able to sense the characteristics of the ambient illumination as a means of reducing the power consumption of the display when the ambient light levels are low, and to provide a good quality output when the ambient light levels are high.

The required light sensors can be formed as part of the active plate using thin film technology, and this is a convenient way of adding the light sensor capability without requiring additional process steps or separate components. The light sensitive devices may for example be thin film transistors, thin film diodes, lateral diodes or light sensitive resistors.

However, in the case where the display makes use of a light source for illumination (this may be a backlight or a frontlight) it can be difficult to optically isolate the light sensors from this light source.

This problem is illustrated in FIG. 1 which shows a display system having a display 10, a backlight 12, a light sensor 14 and control circuitry 16 for operating the display and the backlight. A signal is fed from the light sensor 14 to the controller 16 so that the controller can modify the operation of the display and the backlight in response to changes in the detected illumination.

There will be contributions to the output signal from the sensor 14 which result from the ambient light 18 at the front of the display and from the light 20 generated by the backlight 12. In order to correctly adjust the operation of the display and backlight, it is necessary to differentiate between the light from these two sources.

WO 20007/069107 discloses a system in which light sensors are used to enable both ambient illumination levels and backlight output levels to be measured.

FIG. 2 shows in a simplified form the way in which the light sensor can be integrated within the display. In this example, the display is formed from two glass substrates 24, 26 with a liquid crystal layer 28 between them. In this example, the light sensor is arranged as an array of light sensor elements 30 which are fabricated on the lower substrate 26 which is closest to the backlight 42 (or backlight light guide) of the display. The sensor might be a thin film diode, thin film transistor or other photosensitive device. Ambient light from the front of the display is able to pass through the upper substrate 24 and the liquid crystal layer 28 to reach the light sensor 30.

The sensor can also receive ambient light which has passed through the display and has been modulated by the display pixels as indicated by the example light path 31. The sensor may also receive light from the backlight of the display as indicated by light paths 32 and 34, and which has passed through the lower substrate 26.

When measuring the ambient illumination, the contributions to the output signal from the modulated ambient light and from the backlight are undesirable and should be minimised and ideally eliminated.

It is possible to block the direct path of light from the backlight to the light sensor, for example by providing an opaque layer at the base of the thin film layers defining the light sensor. However, light from the backlight will be reflected or guided within the substrates of the display and will therefore still reach the sensors via an indirect path. This indirect light path is shown by arrows 32, whereas the direct path is shown as 34.

For completeness, FIG. 2 shows a light masking layer 36. The use of a black mask layer is well known to shield the areas of the active plate through which unmodulated light can pass, and to shield the transistors as their operating characteristics are light-dependent. The top and bottom polarizers 38, 40 are also shown. The black mask layer has an opening to allow ambient light to reach the sensor 30.

The light sensors can be integrated within the display pixels, or a smaller number of light sensor devices may be provided at the edge of the pixel array.

Another problem faced when integrating ambient light sensors on display substrates is that the ambient light level can vary over a very wide range, from more than 100,000 lux in direct sunlight down to just a few lux at night or in a darkened room. When measuring low light levels, the leakage current (dark current) of the photodiode or phototransistor is a significant source of errors. At low and medium light levels, in the case of an LCD, light from the backlight or front light can significantly alter the output signal of the sensor which may prevent the ambient light level from being measured.

This can be avoided by turning off the backlight or front light during the measurement, but at high ambient light levels the light source should be operated continuously to maximise the display brightness.

In order to measure the ambient light level under these different conditions it is necessary to change the way in which the measurement is performed. This can lead to a discontinuity in the output of the measurement when the measurement mode is changed.

BRIEF SUMMARY OF THE INVENTION

According to the invention, there is provided a method of controlling a display device, the display device comprising a display modulator for modulating the light provided by the illumination source, the method comprising: using a light sensor arrangement to generate a first signal based on an ambient light level with first illumination source drive condition; using the light sensor arrangement to generate a second signal based on the same ambient light level but with second illumination source drive condition different to the first drive condition; processing the first and second signals to compensate for differences in the light sensor arrangement response characteristics when operating with the first and second illumination source drive conditions thereby to derive a compensated light sensor arrangement characteristic covering both the first and second illumination source drive conditions; and controlling the display device using a detected light level based on the light level as detected by the light sensor arrangement based on the compensated light sensor arrangement characteristic.

This method uses light sensors for measuring the ambient illumination and in which the measurement is performed using two or more measurement modes with different illumination source drive conditions. For example, these modes depend on the intensity of the ambient light. The generation of a compensated light sensor characteristic (i.e. a model of the transfer function) ensures continuity of the output of the measurement when moving from one measurement mode to another. This is achieved by comparing the results of measurements made using the modes and applying corrections for differences.

Controlling the display device preferably comprises controlling the illumination source, and a number of known control techniques can be applied based on an accurate determination of the ambient light level.

The first illumination source drive condition may comprise the illumination source on, and the second illumination source drive condition may then comprise the illumination source off.

Preferably, generating a signal with first and second drive conditions comprises (in each case): detecting a light level with a first light sensor exposed to ambient light at the display output; detecting a light level with a second light sensor more shielded from ambient light than the first light sensor; and processing the signals generated by the first and second sensors to derive an ambient light level.

Thus, each light sensor signal already compensates for unwanted illumination reaching the sensor. This is achieved because the relative contribution of the unwanted illumination is made similar for the two sensors, whereas the contribution of the desired ambient light to be measured is made very different. The processing can thus comprise subtracting the signal generated by the second sensor from the signal generated by the first sensor to derive an ambient light level.

The compensation can comprise linearly shifting the light sensor arrangement response characteristic in one of the illumination source drive conditions to remove discontinuity between the light sensor arrangement response characteristics for the two illumination source drive conditions. This then creates a continuous single linear relationship.

In a preferred example, the method comprises: using the light sensor arrangement to generate a third signal based on a second ambient light level with the first illumination source drive condition; using the light sensor arrangement to generate a fourth signal based on the same second ambient light level but with the second illumination source drive condition; and processing the first to fourth signals to compensate for differences in the light sensor arrangement response characteristics when operating with the first and second illumination source drive conditions thereby to derive a compensated light sensor arrangement characteristic covering both the first and second illumination source drive conditions.

In this case, the extra sensor measurements mean that the compensation can comprise linearly shifting and changing the gradient of the light sensor arrangement response characteristic in one of the illumination source drive conditions to remove discontinuity and change in gradient between the light sensor arrangement response characteristics for the two illumination source drive conditions.

The invention also provides a computer program comprising computer program code means adapted to perform the method of the invention.

The invention also provides a display device comprising: an illumination source, a display modulator, a light sensor arrangement, and a processor. The display modulator modulates the light provided by the illumination source. The light sensor arrangement generates signals based on an ambient light level and the illumination source. The processor processes the signals received from the light sensor arrangement. The processor is adapted to: use the light sensor arrangement to generate a first signal based on an ambient light level with first illumination source drive conditions; use the light sensor arrangement to generate a second signal based on the same ambient light level but with second illumination source drive conditions different to the first drive conditions; process the first and second signals to compensate for differences in the light sensor arrangement response characteristics when operating with the first and second illumination source drive conditions thereby to derive a compensated light sensor arrangement characteristic covering both the first and second illumination source drive conditions; and control the display device using a detected light level based on the light level as detected by the light sensor arrangement based on the compensated light sensor arrangement characteristic.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The same reference numbers are used in different figures to denote the same components, and description is not repeated.

The invention provides a display device in which light measurement is performed using two or more measurement modes with different illumination source drive conditions. The light sensor signals are processed so that a compensated light sensor characteristic (i.e. a model of the transfer function) ensures continuity of the output of the measurement when moving from one measurement mode to another.

As explained above, when measuring the ambient illumination, the contribution derived from modulated ambient light and from light from the backlight should be cancelled.

One way to achieve this is to introduce a second sensor which has a different sensitivity to the ambient light level but a similar sensitivity to the unwanted components of light.

Figure 2:
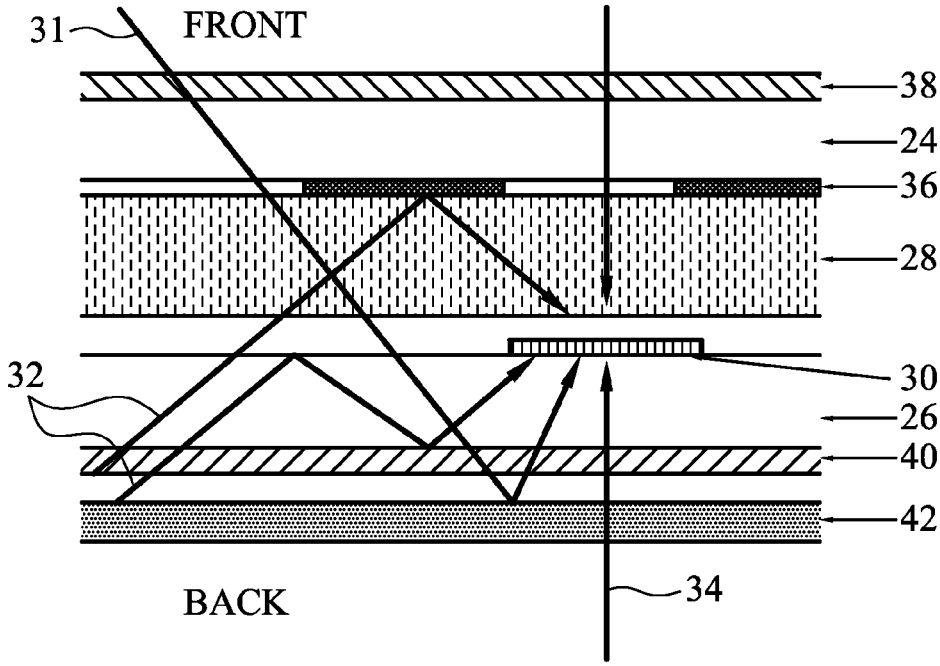
FIG. 2 (PRIOR ART)
FIG. 2 shows a cross section through a known active matrix liquid crystal display using integrated light sensors, and which can be used in a display device of the invention.
Figure 3:
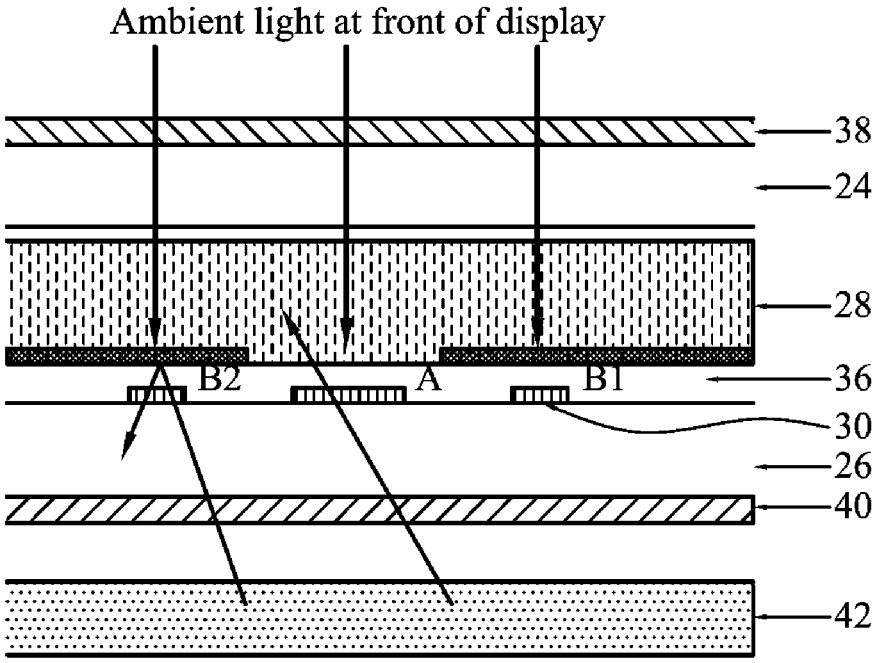
FIG. 3 shows a cross section through an active matrix liquid crystal display using multiple integrated light sensors proposed by the applicant.

An example of such an arrangement is shown in FIG. 3. The sensor arrangement 30 comprises a first sensor A which is exposed to the ambient illumination, while a second sensor B is covered by the light masking layer 36 (in this example shown beneath the liquid crystal layer rather than on top as in FIG. 2) so that its output contains a much lower contribution from the ambient light when compared to sensor A.

Good matching of the characteristics of the sensors is an advantage so they may be arranged with a common centroid layout as shown in FIG. 3. Sensor B has the same area as sensor A but is divided into two equal parts, B1 and B2, which are located on either side of sensor A.

The output signals of sensor A and sensor B can be described by equations 1 and 2 respectively.

$$S_1=k_{11}L_A+k_{12}k_ML_A+k_{13}L_B+k_{14}L_D \quad \text{Equation 1}$$

$$S_2=k_{21}L_A+k_{22}k_ML_A+k_{23}L_B+k_{24}L_D \quad \text{Equation 2}$$

$L_A$ represents the ambient light level $k_{11}$ and $k_{21}$ represent the sensitivity of the first and second sensors to the ambient light and take into account the amount of ambient light which reaches the sensor and the efficiency with which the light reaching the sensor is converted to produce the output signal.

$k_{12}$ and $k_{22}$ represent the sensitivity of the two sensors to the modulated ambient light.

$k_M$ represents the modulation of the ambient light by the display pixels and varies depending on the displayed image.

$L_B$ represents the backlight brightness.

$k_{13}$ and $k_{23}$ represent the sensitivity of the two sensors to the backlight.

$L_D$ represents the background signal of the sensor, for example the dark current of a photodiode, expressed in terms of a corresponding light intensity.

$k_{14}$ and $k_{24}$ convert the background signal light intensity representation into the effect on the sensor signal output.

When measuring the ambient light level, $L_A$ represents the wanted signal and $k_ML_A$, $L_B$ and $L_D$ contribute to unwanted components of the sensor output. By designing two sensors such that their outputs contain quite different contributions from the wanted signal and similar contributions from the unwanted signal components, it is possible to increase the relative magnitude of the wanted signal to the unwanted signal components by subtracting the output of one sensor from the other.

This can be illustrated by considering Equation 3 which represents the difference between the output signals of sensor 1 and sensor 2.

$$S_1-S_2=(k_{11}-k_{21})L_A+(k_{12}-k_{22})k_ML_A+(k_{13}-k_{23})L_B+(k_{14}-k_{24})L_D \quad \text{Equation 3}$$

If the sensors are engineered so that:

$k_{11}$ is much larger than $k_{21}$, $k_{12}$ is approximately equal to $k_{22}$, $k_{13}$ is approximately equal to $k_{23}$ and $k_{14}$ is approximately equal to $k_{24}$, then the wanted component of the resulting signal can be increased compared to the unwanted components. In the ideal case, $k_{12}$ would be equal to $k_{22}$, $k_{13}$ would be equal to $k_{23}$ and $k_{14}$ would be equal to $k_{24}$ resulting in elimination of the unwanted components and leading to Equation 4.

$$S_1-S_2=(k_{11}-k_{21})L_A \quad \text{Equation 4}$$

This subtraction of the unwanted signals works well providing that the unwanted signal components are not too large compared to the ambient light component. When the ambient light level is low or medium, for example below 5000 lux, if an ambient light measurement is made when the backlight is turned on then $L_B$ can be much larger than $L_A$. In practical situations, $k_{13}$ is unlikely to be exactly equal to $k_{23}$ and therefore the result of the measurement of ambient light may be significantly affected by the backlight.

This problem can be overcome by making the ambient light measurement with the backlight turned off. This works well at low ambient light levels because pulse width modulation is typically used to control the brightness of the backlight and therefore the ambient light measurement can be made during one of the periods when the backlight is turned off. However, at high ambient light levels, the backlight should be operated with a duty cycle of 100% to provide the maximum brightness. Under these circumstances, it is necessary to measure the ambient light level with the backlight turned on.

Figure 4:
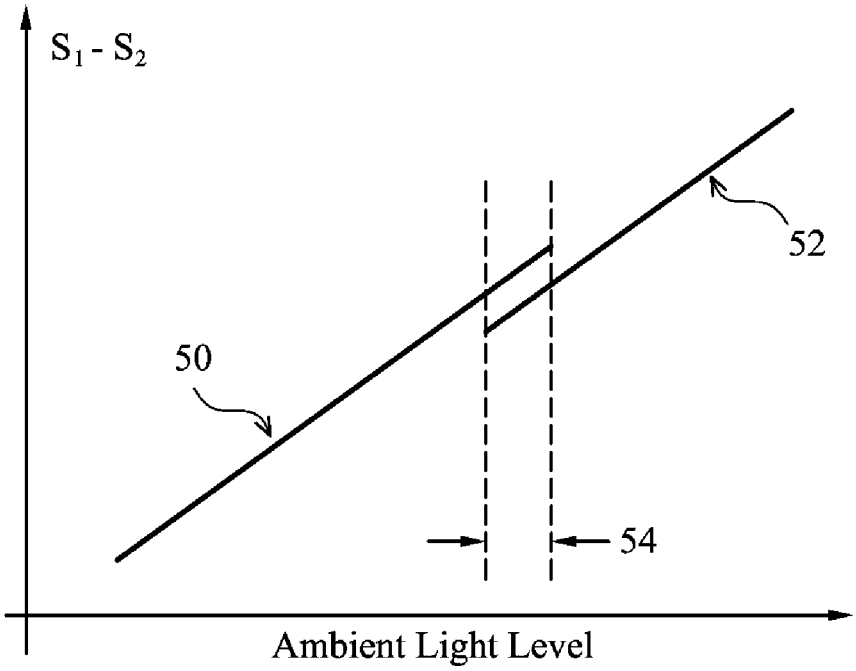
FIG. 4 is a first graph to show how discontinuity can arise from different sensing modes.

The consequence of this is illustrated in FIG. 4. This shows a representation of the dependence of the difference signal from the two sensors, $S_1-S_2$, on the ambient illumination level. At low ambient light levels, the measurements are made with the backlight turned off and this gives plot 50. At high light levels the backlight is turned on, and this gives plot 52.

When the backlight is turned off, the output signal of the measurement can be approximated by Equation 4 above since $L_B$ is equal to zero. However, when the backlight is turned on the component of the output resulting from the backlight cannot be neglected due to the large value of $L_B$ and therefore the signal is represented by equation 5 below.

$$S_1-S_2=(k_{11}-k_{21})L_A+(k_{13}-k_{23})L_B \quad \text{Equation 5}$$

This difference in the output signal depending on which measurement mode is used can cause problems when the output signal controls aspects of the operation of the display, for example the brightness of the backlight. A correction parameter could be measured at the time that the display is made and then stored in the display module, but the light output of the backlight will change and over time and therefore the correction parameter will need to be re-measured periodically.

The invention provides automatic calibration of the light sensor, to be performed when moving between measurement modes. As indicated in FIG. 4, there will be a range of ambient light levels over which it is possible to carry out measurements using both measurement modes. This is region 54. The measurements made with the backlight turned off can be used as the reference and then comparison made with measurements made with the backlight turned on, in order to calculate the correction parameters required to eliminate the contribution to the output signal resulting from the backlight.

Figure 5:
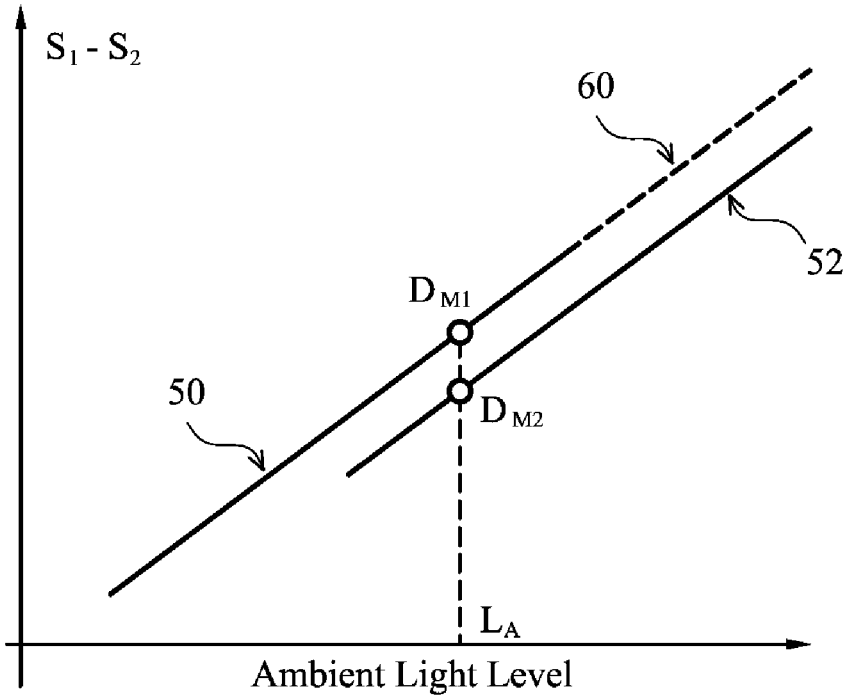
FIG. 5 is a second graph used to explain a first example of light sensor control method of the invention.

For example, as illustrated in FIG. 5, the two measurements $D_{M1}$ and $D_{M2}$ which are made under the same ambient lighting conditions can be used to calculate the correction parameters. The output signals of the sensors have a linear dependence on the ambient light level. In the simplest case, it can be assumed that when the measurement is made with the backlight turned on this produces an offset in the characteristics of the output signal of the sensor but that the slope of the characteristic is unchanged.

The dotted region 60 shows the plot of the measurement made with the backlight turned on, after the correction has been made.

A correction parameter $k_O$ can be defined which can be added to the result of measurements made when the backlight is turned on in order to generate a result which is consistent with the measurements made when the backlight is turned off. This is illustrated by Equations 6 and 7.

$$k_O = D_{M1} - D_{M2} \quad \text{Equation 6}$$

$$\text{Corrected measurement} = \text{Uncorrected measurement} + k_O \quad \text{Equation 7}$$

Although this process of calculating the correction parameters has been described in terms of discrete measurements, in practice it is likely that the outputs of the sensors will be processed or filtered in order to reduce the effect of noise in the output signal of the sensors. Therefore the measurements $D_{M1}$ and $D_{M2}$ can also be considered to be results generated by processing groups of samples of the sensor outputs which have been taken over substantially the same time window.

If the slope of the sensor characteristic changes when the mode of the ambient light measurement changes then a more complex correction is required. This might be the case if different sensors are used for measurements at high ambient light levels, for example smaller sensors may be used to measure the higher ambient light levels.

In this case, at least four measurement results are required to determine the ratio of the slopes of the characteristics for the two measurement modes, $k_S$. This calculation is represented in Equation 8:

$$k_S = \frac{D_{M1B} - D_{M1A}}{D_{M2B} - D_{M2A}} \quad \text{Equation 8}$$

The measurements should be made at two different values of ambient light level which fall within the range where both measurement modes can be used. Two measurements are required to determine the difference in the offset of the two measurements, $k_O$, as indicated in Equation 9:

$$k_O = D_{M1A} - k_S D_{M2A} \quad \text{Equation 9}$$

Measurements made in the measurement mode where the backlight is turned on can then be corrected according to equation 10.

$$\text{Corrected measurement} = k_S \times \text{Uncorrected measurement} + k_0 \quad \text{Equation 10}$$

The correction parameters may be stored and modified over time as the display is operated under ambient lighting conditions which require the measurement mode to be varied. A running average of the correction parameters may be established and stored when the display is not being used so that the parameters are available then next time that the display is turned on. If the correction parameters are not stored when the display is turned off, then they can be determined when the display is turned on by introducing the required measurements with the backlight turned off and turned on into the start-up sequence of the display.

The specific case of measurement modes where the display backlight is turned off or turned on has be described. However, other measurement modes may also be implemented which require a correction to be performed when switching from one mode to another in order to produce a signal which represents the ambient light level which is free from discontinuities.

Figure 7:
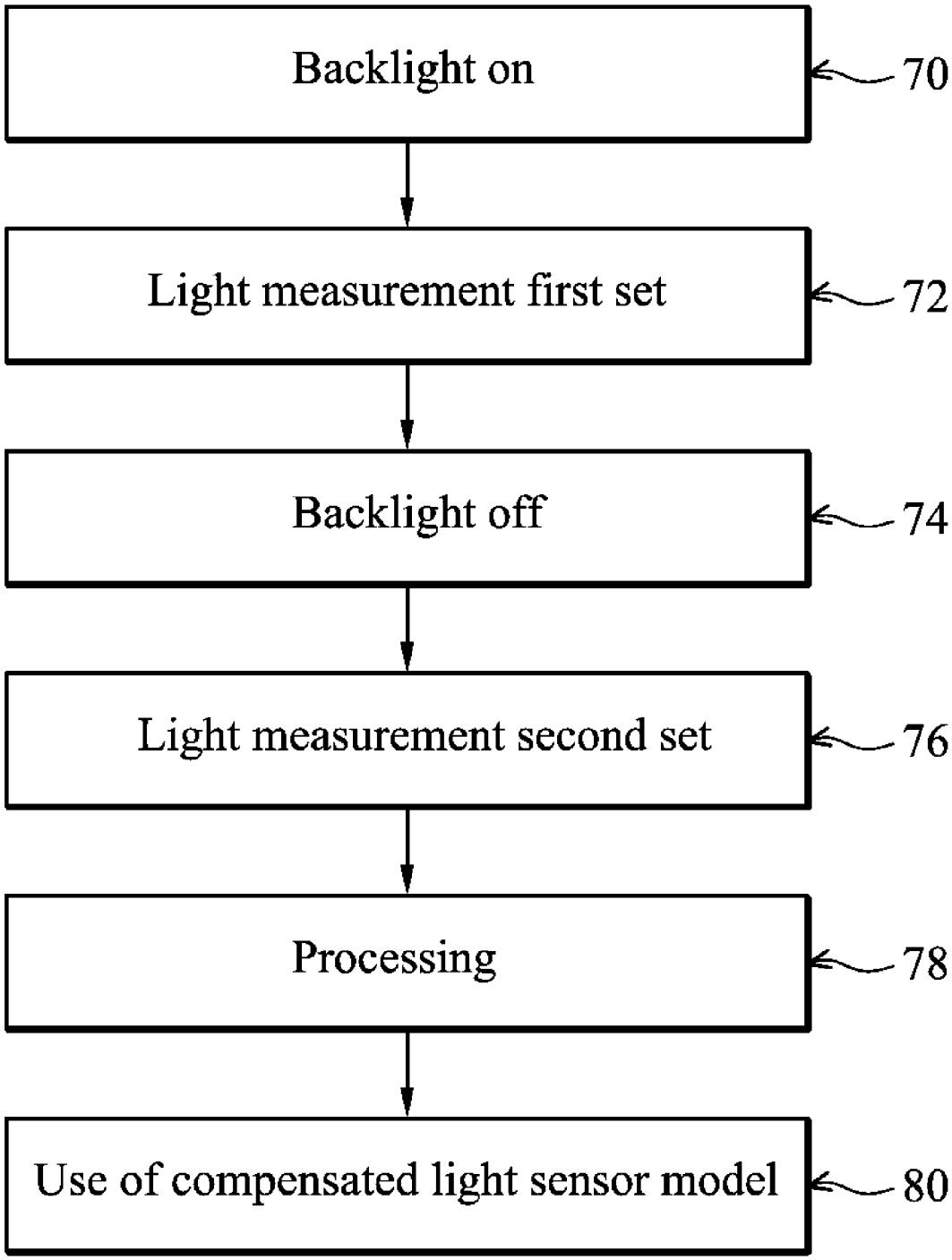
FIG. 7 shows an example of method of the invention.

FIG. 7 shows the method of the invention as a flow of processing steps.

In step 70, the backlight is turned on. A first set of signals is obtained in step 72 from the light sensor arrangement with the backlight on, and in the region of ambient levels where signals will be taken with the backlight on and off.

In step 74, the backlight is turned off, and in step 76, a second set of signals is obtained from the light sensor arrangement with the backlight off, for the same ambient light level (i.e. sufficiently close in time that the ambient light has not changed).

In step 78, the first and second sets of signals are processed and a compensated light sensor arrangement characteristic is derived, covering both the first and second illumination source drive conditions.

In step 80, the display device is controlled using a measured detected light level. The compensated characteristic can be updated periodically, for example each time the ambient light levels are in the correct range.

In the description above, the illumination source is shown as a backlight for the sake of clarity, although it will be appreciated that front illumination display systems also exist and the invention is also applicable to such displays.

Figure 1:
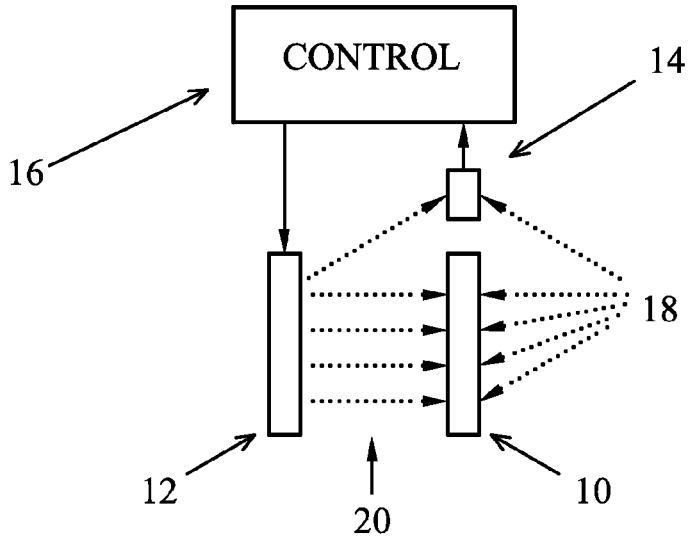
FIG. 1 (PRIOR ART)
FIG. 1 shows a plan view of a known display using light sensing to control the backlight output level, and which can be controlled to implement the method of the invention.

The invention can be implemented using the display designs shown in FIGS. 1 and 2, and provides a different method of processing the signals from multiple light sensors, implemented by the controller 16 for controlling the backlight and providing the computations.

The light sensor is preferably an integrated thin film device formed using the same thin film layers used to form a display pixel array, and the light sensor may be arranged as an array of light sensor elements, with one light sensor element integrated into each display pixel, or arranged around the periphery of the display.

The invention can be used to implement ambient light sensors in LCD or other light modulating displays with rear or front illumination, and enables control of the illumination source such that there is a smooth transition between the response of the light sensor arrangement between operating modes, particularly backlight-on and backlight-off modes.

The obtained information concerning ambient light levels can be used in known manner to adjust the backlight (or other light source) output to implement power savings in dark ambient light conditions and to ensure good image visibility in bright ambient light conditions.

In the examples above, the output of the computation is used to control the illumination source of the display, but it might instead or additionally be used to control other aspects of the display operation, for example changing the brightness, contrast or gamma settings of the display, or the refresh frequency.

One way of performing the required calculations for processing the light sensor signals is by a computer program but the same method could be implemented using analogue or digital circuits.

In the simplest case, some averaging of measurement results might be achieved by integrating the output obtained from the light sensing device for a number of measurements. This integration could be performed within the light sensor circuit, for example, by integrating the current from a photodiode onto a capacitor during selected measurement periods. Separate capacitors can be used for the different drive conditions of the illumination source. For example, separate capacitors could be used to integrate the photodiode current during measurements which occur with the backlight on and off.

The voltages established on the two capacitors would then represent the sum of measurements corresponding to each of the backlight modes.

Figure 6:
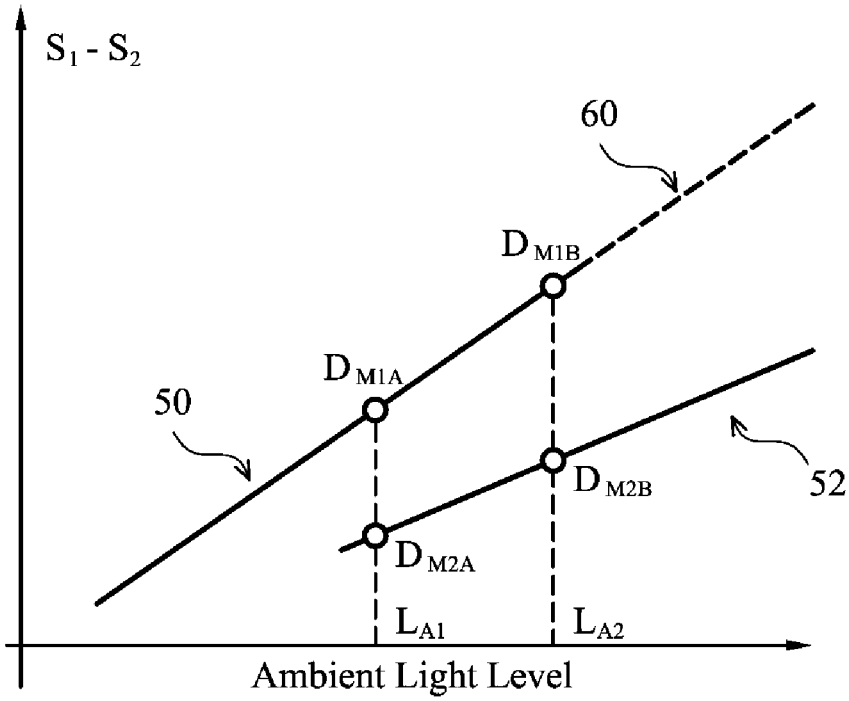
FIG. 6 is a third graph used to explain a second example of light sensor control method of the invention.

More complex computation taking as input a sequence or a set of measurement values sampled over time with different illumination source drive conditions may also be used. Thus, FIGS. 5 and 6 are only examples of the possible processing schemes which can be implemented. Furthermore, the relationship between light sensor output and the light level has been shown as perfectly linear. This does not have to be the case, and the invention applies for different transfer functions. Essentially, the best match is found in the region of overlap between the two transfer functions, so as to provide a substantially combined single transfer function.

If the duration of the measurements is different in the different modes, then the output of the two measurements can be scaled in order to take into account the different integration periods and the equations will be modified accordingly.

As mentioned above, the brightness of the backlight can be changed by adjusting the pulse width or pulse frequency for a given pulse width of a pulsed illumination source output.

The invention may be applied to other display types having an illumination source, such as transflective displays.

Various modifications will be apparent to those skilled in the art.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of controlling a display device, the display device comprising an illumination source and a display modulator modulating light provided by the illumination source, the method comprising:

using a light sensor arrangement in the display device to generate a first signal based on an ambient light level with a first illumination source drive condition, wherein the step of generating the first signal comprises:

detecting a light level with a first light sensor exposed to ambient light at an output of the display to generate a third signal;

detecting a light level with a second light sensor more shielded from the same ambient light than the first light sensor to generate a fourth signal; and processing the third and fourth signals generated by the first and second sensors to derive the first signal;

using the light sensor arrangement in the display device to generate a second signal based on the same ambient light level but with a second illumination source drive condition, wherein the second illumination source drive condition is different to the first illumination source drive condition, and wherein the second illumination source drive condition and the first illumination source drive condition are implemented at different times, wherein the step of generating the second signal comprises:

detecting a light level with the first light sensor exposed to the same ambient light at the display output to generate a fifth signal;

detecting a light level with the second light sensor more shielded from the same ambient light than the first light sensor to generate a sixth signal; and processing the fifth and sixth signals generated by the first and second sensors to derive the second signal;

processing the first and second signals to generate a first correction parameter and correcting the first signal using the first correction parameter to generate a corrected signal; and controlling the display device based on the corrected signal.

2. The method as claimed in claim 1, wherein the step of controlling the display device comprises controlling the illumination source.

3. The method as claimed in claim 2, wherein the first illumination source drive condition comprises the illumination source on, and the second illumination source drive condition comprises the illumination source off.

4. The method as claimed in claim 1, wherein the first illumination source drive condition comprises the illumination source on, and the second illumination source drive condition comprises the illumination source off.

5. The method as claimed in claim 1, wherein the step of processing the third and fourth signals generated by the first and second sensors comprises subtracting the fourth signal generated by the second sensor from the third signal generated by the first sensor to derive the first signal.

6. The method as claimed in claim 1, wherein the step of processing the fifth and sixth signals generated by the first and second sensors comprises subtracting the sixth signal generated by the second sensor from the fifth signal generated by the first sensor to derive the second signal.

7. The method as claimed in claim 1, wherein the step of processing the first and second signals comprises linearly shifting the light sensor arrangement response characteristic in one of the first and second illumination source drive conditions to remove discontinuity between the light sensor arrangement response characteristics for the first and second illumination source drive conditions.

8. The method as claimed in claim 7, wherein the step of processing the first and second signals comprises linearly shifting and changing the gradient of a light sensor arrangement response characteristic in one of the illumination source drive conditions to remove discontinuity and change in gradient between light sensor arrangement response characteristics for the two illumination source drive conditions.

9. The method as claimed in claim 1, further comprising:

using the light sensor arrangement to generate a third signal based on a second ambient light level with the first illumination source drive conditions;

using the light sensor arrangement to generate a fourth signal based on the same second ambient light level but with the second illumination source drive condition; and processing the first to fourth signals to compensate for differences in light sensor arrangement response characteristics when operating with the first and second illumination source drive conditions thereby to derive a compensated light sensor arrangement characteristic covering both the first and second illumination source drive conditions.

10. The method as claimed in claim 1, wherein the illumination source is controlled to provide a desired output level using pulse width modulation control.

11. A display device comprising:

an illumination source;

a display modulator for modulating light provided by the illumination source;

a light sensor arrangement generating signals based on an ambient light level and the illumination source; and a processor processing the signals received from the light sensor arrangement, wherein the processor is adapted to:

use the light sensor arrangement to generate a first signal based on an ambient light level with first illumination source drive condition;

use the light sensor arrangement to generate a second signal based on the same ambient light level but with second illumination source drive condition different to the first drive condition, wherein the second illumination source drive condition and the first second illumination source drive condition are implemented at different times;

process the first and second signals to generate a first correction parameter and correcting the first signal using the first correction parameter to generate a corrected signal; and control the illumination source based on the corrected signal, wherein the processor is further adapted to:

use the light sensor arrangement to generate a third signal based on a second ambient light level with the first illumination source drive condition;

use the light sensor arrangement to generate a fourth signal based on the same second ambient light level but with the second illumination source drive condition; and process the first to fourth signals to compensate for differences in light sensor arrangement response characteristics when operating with the first and second illumination source drive conditions thereby to derive a compensated light sensor arrangement characteristic covering both the first and second illumination source drive conditions.

12. A method as claimed in claim 1, wherein the first correction parameter is a difference between the first and second signals and the corrected signal is a sum of the first correction parameter and the first signal.

13. A method as claimed in claim 1, wherein the first signal and the second signal are generated at different times.

14. A method as claimed in claim 1, wherein the display device comprises a display pixel array.

15. The display device as claimed in claim 11, wherein the first correction parameter is a difference between the first and second signals and the corrected signal is a sum of the first correction parameter and the first signal.

16. The display device as claimed in claim 11, wherein the first signal and the second signal are generated at different times.

17. The display device as claimed in claim 11, wherein the display device comprises a display pixel array.

* * * * *